US008112961B2

(12) United States Patent
Wang Chen

(10) Patent No.: US 8,112,961 B2
(45) Date of Patent: Feb. 14, 2012

(54) TWO PART GRILLE WITH INTERLOCKING CONNECTIONS FOR ASSEMBLY IN DOORS OR THE LIKE

(75) Inventor: Kuei Yung Wang Chen, Taipei (TW)

(73) Assignee: Nan Ya Plastics Corporation, Taipei (TW)

( * ) Notice: Subject to any disclaimer, the term of this patent is extended or adjusted under 35 U.S.C. 154(b) by 0 days.

(21) Appl. No.: 12/855,365

(22) Filed: Aug. 12, 2010

(65) Prior Publication Data

US 2011/0097987 A1 Apr. 28, 2011

Related U.S. Application Data

(62) Division of application No. 12/068,984, filed on Feb. 14, 2008, now Pat. No. 7,797,904.

(51) Int. Cl.
*E04B 2/00* (2006.01)

(52) U.S. Cl. ..... 52/592.1; 52/473

(58) Field of Classification Search ..... 52/171.1, 52/204.53, 204.54, 204.55, 204.7, 205, 473, 52/656, 656.7, 717.01, 592.1, 592.4, 592.5, 52/592.6, 208, 204.71, 204.72, 204.61; 49/504; 160/104, 371, 392; 454/195, 280, 284
See application file for complete search history.

(56) References Cited

U.S. PATENT DOCUMENTS

| | | | | | |
|---|---|---|---|---|---|
| 2,509,016 | A | * | 5/1950 | Peterson | 454/279 |
| 2,663,246 | A | | 12/1953 | Smith | |
| 2,820,407 | A | | 1/1958 | Smith | |
| 2,897,889 | A | | 8/1959 | Kessler | |
| 3,084,736 | A | * | 4/1963 | Mentel et al. | 431/329 |
| 4,021,967 | A | * | 5/1977 | Mulder et al. | 49/171 |
| 4,189,880 | A | | 2/1980 | Ballin | |
| 4,856,575 | A | * | 8/1989 | Wells | 160/353 |
| 4,989,381 | A | | 2/1991 | De Block et al. | |
| 5,133,168 | A | | 7/1992 | Neilly et al. | |
| 5,365,707 | A | | 11/1994 | Jones et al. | |
| 5,577,355 | A | | 11/1996 | Leonelli | |
| 5,644,881 | A | | 7/1997 | Neilly | |
| 7,010,888 | B2 | | 3/2006 | Tumlin et al. | |

* cited by examiner

*Primary Examiner* — William V Gilbert
*Assistant Examiner* — Theodore Adamos
(74) *Attorney, Agent, or Firm* — Bacon & Thomas, PLLC

(57) ABSTRACT

A two part grille with interlocking connections molded from opaque plastic allows one or more screens or filters supported inside the grille and provides a configuration which allows its parts to be fitted on opposite sides of an opening in a wall or a door locked together by a mortise and tenon joint so that no screws are necessary, and the two part grille further has intermediate spacers used to accommodate differing thickness of a wall or the like.

4 Claims, 5 Drawing Sheets

TWO PART GRILLE WITH INTERLOCKING CONNECTIONS FOR ASSEMBLY IN DOORS OR THE LIKE

CROSS REFERENCE TO RELATED APPLICATIONS

This application is a divisional of U.S. application Ser. No. 12/068,984, filed Feb. 14, 2008, now pending. The patent application identified above is incorporated by reference in its entirety to provide continuity of disclosure.

BACKGROUND OF THE INVENTION

1. Field of the Invention

This invention relates generally to a two part grille with interlocking connections on a backside of the parts for assembling a grille in an opening in a door or the like with the benefit of no screws or the like necessary.

2. Description of Prior Art

Natural ventilation generally means that sufficient fresh air may be channeled into indoor room to reach the purpose of dissipating the heat accumulated in the building or diluting and dispelling the harmful or bad material from the air.

For this purpose of ventilation mentioned above, metal and wood grilles for openings in doors and windows are well known. However metal grilles do not have good weathering qualities, being subject to rusting and pealing paint. Likewise wooden grilles need periodic painting and are often subject to warping of its components when exposed to moisture.

BRIEF SUMMARY OF THE INVENTION

The current invention relates to a two part plastic grille made of opaque plastics which include preformed mortise and tenon connectors on a backside of parts to lock them together when they are assembled on opposite sides of an opening in a door or wall.

This invention is directed to a grill provided with one or more screens or air filters supported within the grille for allowing natural ventilation through doors and or walls, composed of two parts, with these parts provided with interlocking connections allowing the parts to be fitted on opposite sides of an opening in a wall or door and interlocked by engagement of the mortise and tenon elements on a backside of the two parts, to interlock the parts together so that no screws are necessary.

This grill includes two parts, each having a frame defining a perimeter of each grille part, each part having a series of parallel, horizontal vanes evenly spaced between lateral uprights of its frame with a plurality of cooperation mortise and tenon elements disposed on the back side of each frame whereby two parts are interlocked together by a mortise and tenon joint when these elements are engaged. Further spaces, having a mortise element on one end and tenon element on the other, can be provided between the interlocking mortise and tenon elements to accommodate walls or doors of differing thicknesses.

The design of the two part plastic grille is very convenient in retrofitting openings in doors or walls with a grille to provide natural circulation through the door or wall to improve the air quality in a space, such as a room, by enabling the ingress of fresh air, to, for example, dissipate heat or dilute harmful vapors in such a room.

Because of its simple construction, economical price and ease of installation, the grille of the current invention provides a grating for openings made in doors or walls to facilitate natural air circulation that limits the ingress of insects, birds and the like from passing through the opening.

DETAILED DESCRIPTION OF THE INVENTION

Figure 1:
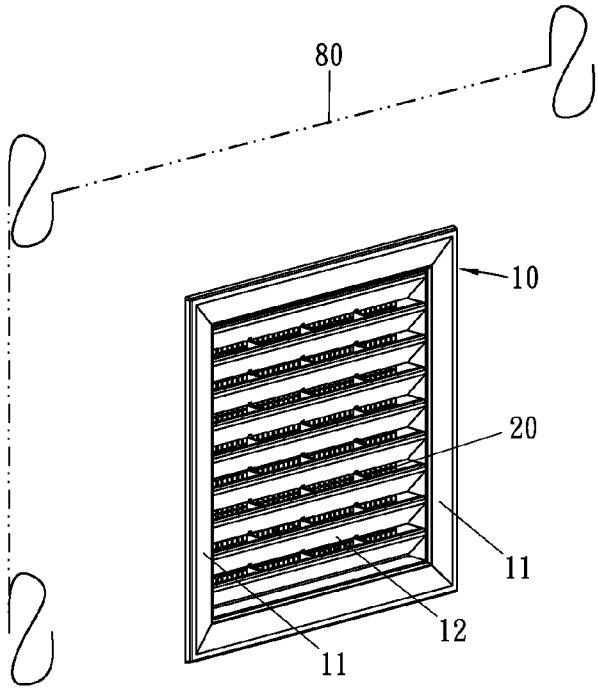
FIG. 1 is a schematic view showing the grille of the present invention fitted into an opening in a wall as grating for ventilation.

As shown in FIGS. 1 to 6, the present invention is disclosed as a two part grille 10 having a configuration which not only allows its parts to be fitted on opposite sides of an opening in a wall 80 or a door 90 locked together by a mortise and tenon joint so that no screws are necessary, but also allows one or more screens or air filters 20 to be supported within the grille 10.

The two parts of the novel grille 10 of the present invention are constructed of a molded opaque plastic composition, chosen for its superior weather resistance and distortion resistance. Each part includes a frame 11 defining a perimeter of that part of the grille 10, with a series of parallel, horizontal vanes 12 evenly spaced between lateral uprights of its frame 11 which forms a grating.

On a back side 13 of each frame 11 of the grille 10 has a plurality of tenon elements 15 and mortise elements 17. It is preferred that these elements alternate between tenon elements 15 and mortise elements 17 on back side 13 of each frame 11.

Further these elements 15 or 17 of each frame 11 are arranged so that the tenon elements 15 will be in registry with the mortise elements 17 and vise verse so that when the back side 13 of each frame 11 is placed on opposite sides of an opening in a wall 80 or a door 90 and these elements 15 or 17 are mutually engaged, the tenon elements 15 (or the mortise elements 17) on each frame 11 will interlock with the mortise elements 17 (or the tenon elements 15) on the other frame 11.

Figure 3:
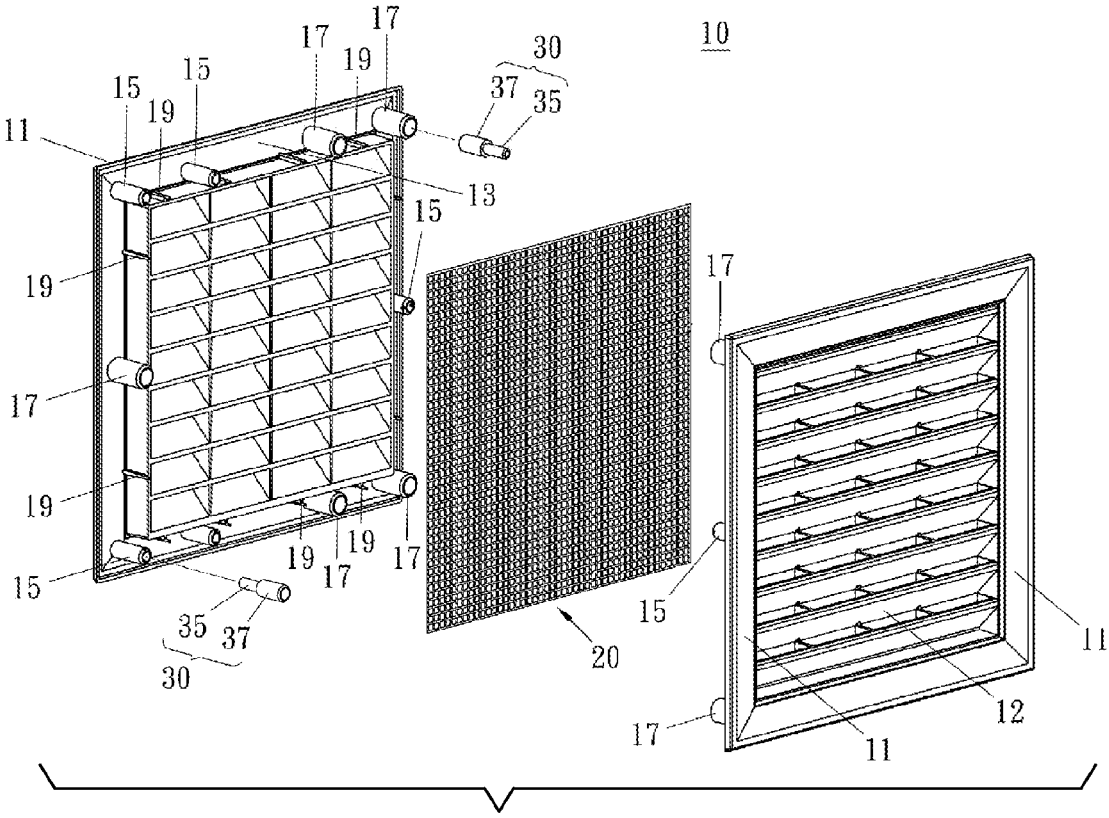
FIG. 3 is an exploded view of the first embodiment of the two parts of the grille of the present invention illustrating the backside of one of the parts having tenon elements and mortise elements thereon; in addition, FIG. 3 further shows a spacer that can be used to extent the tenon elements and mortise elements to accommodated differing thicknesses in walls or doors.
Figure 7:
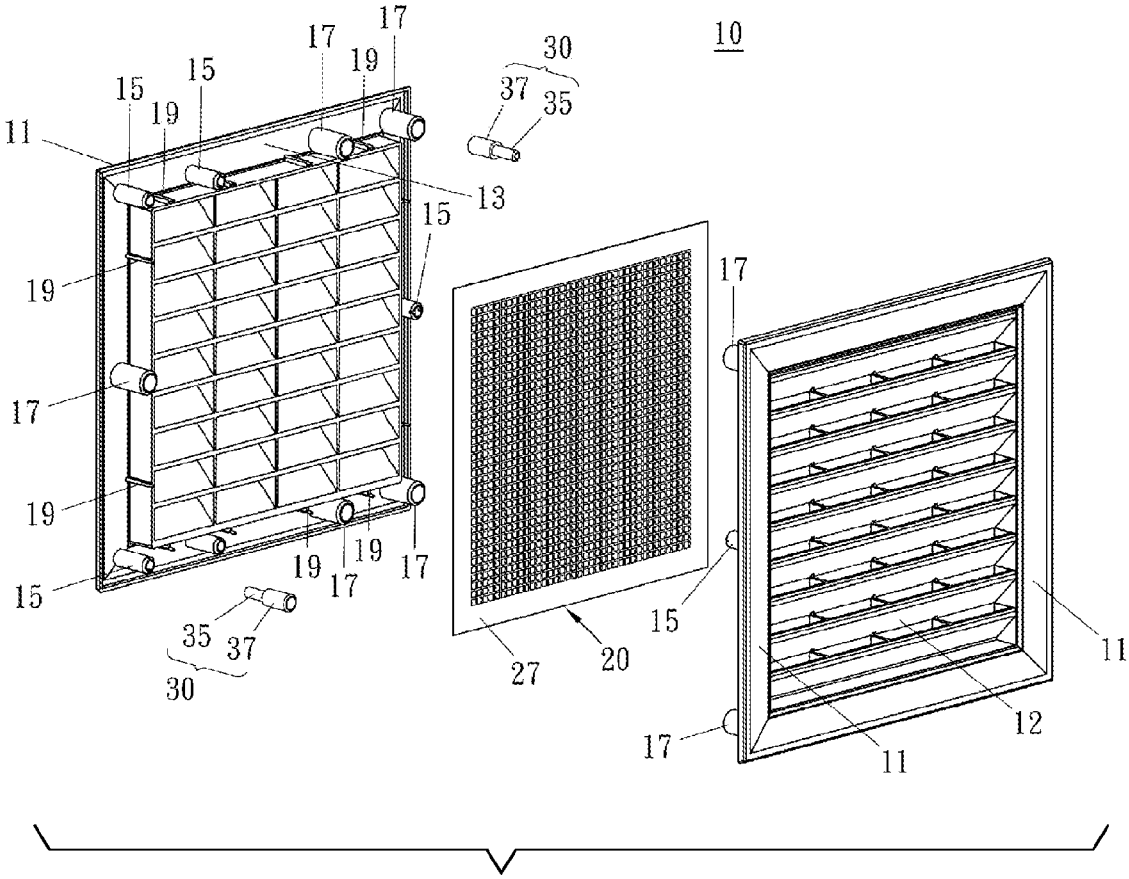
FIG. 7 is an exploded view of the second embodiment of the two parts of the grille of the present invention.
Figure 9:
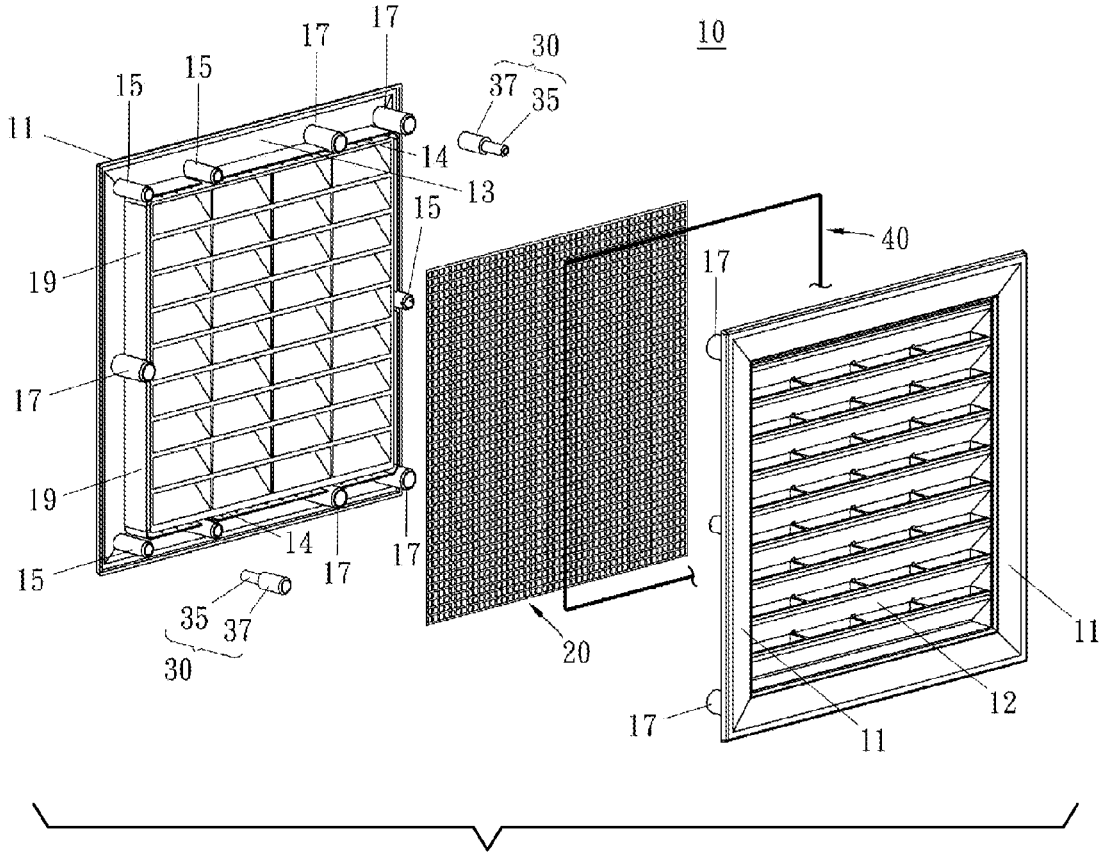
FIG. 9 is an exploded view of the third embodiment of the two parts of the grille of the present invention illustrating the backside of one of the parts having a guide channel formed thereon for matching with a looped packing securely inserted therein.

For installation of the screen(s) or air filter(s) 20 supported between the two opposite frame 11 of the grille 10, on the back side 13 of each frame 11 of the grille 10, in addition to tenon elements 15 and mortise elements 17 formed thereon, further has a plurality of protruding poles 19 as shown in FIG. 3 or FIG. 7 for positioning the screen(s) or air filter(s) 20 in proper location, or, alternatively, has a guide channel 14 formed around the back side 13 of the frame 11 as shown in FIG. 9 for matching with a looped packing 40 to be inserted into the guide channel 14 to position and fasten the screen(s) or air filter(s) 20 in proper location.

Figure 5:
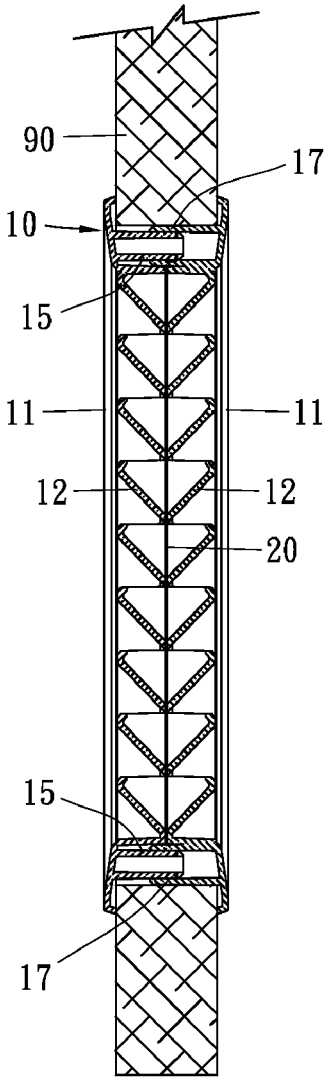
FIG. 5 is a sectional view of an opening in a door having the novel grille assembled therein.
Figure 6:
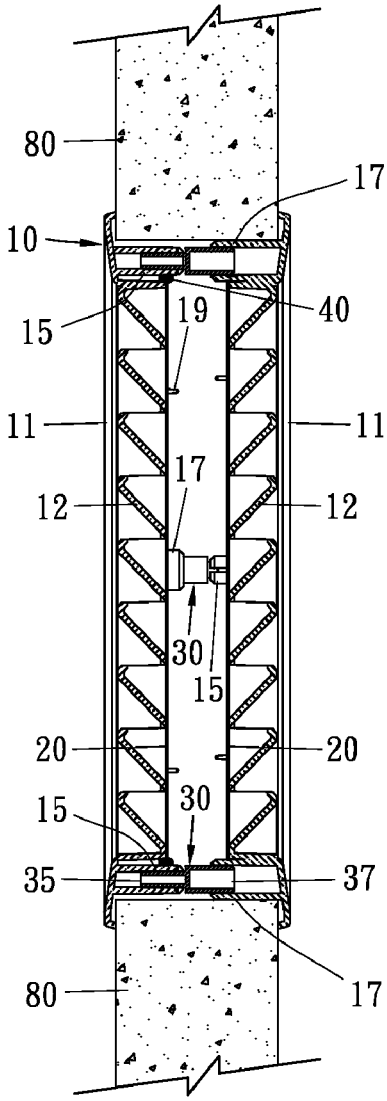
FIG. 6 is a sectional view of a wall opening having the novel grille assembled therein and showing the use of spacers to accommodate the increased thickness of the wall.
Figure 8:
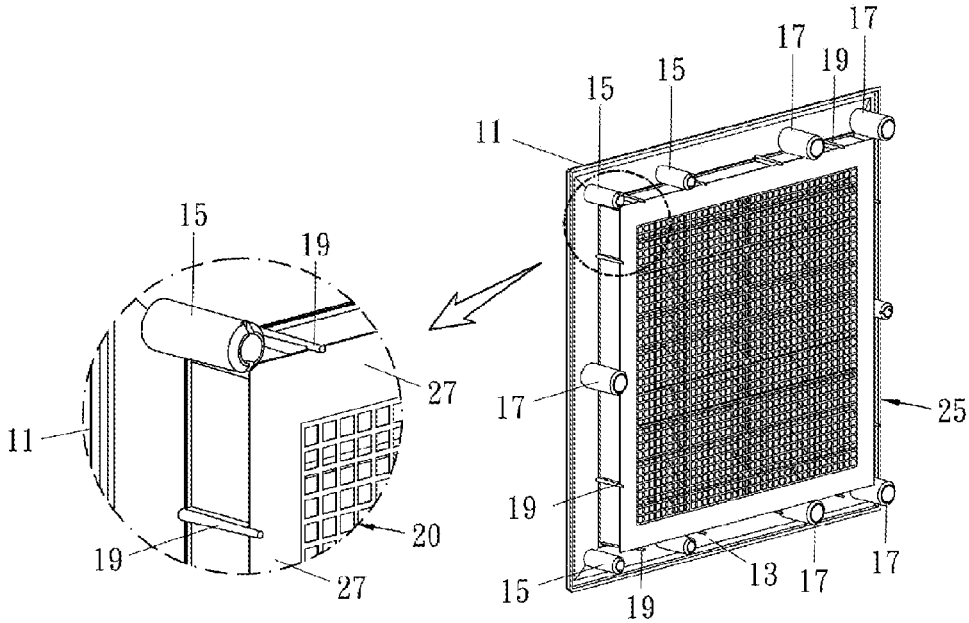
FIG. 8 is a partial assembling view of the second embodiment shown in FIG. 7; in addition, FIG. 8 further has an expanded view cut from the partial assembling view to illustrate a screen or air filter having a reinforced sealing-edge arranged about the periphery and supported on one of the parts through the reinforced sealing-edge of the screen or filter tightly in contact with the protruding poles of said part.

As shown in FIG. 7, the screen or air filter 20 may selectively have a reinforced sealing-edge 27 arranged about its periphery. As shown in FIGS. 7 and 8, this kind of screen or air filter 20 may be positioned and installed on each frame 11 of the grille 10, after the whole reinforced sealing-edge 27 of the screen or air filter 20 has been tightly in contact with the whole protruding poles 19 of the frame 11. As illustrated in FIG. 5 or FIG. 6, the result is that this kind of screen or air filter 20 may be supported within the grille 10.

Figure 4:
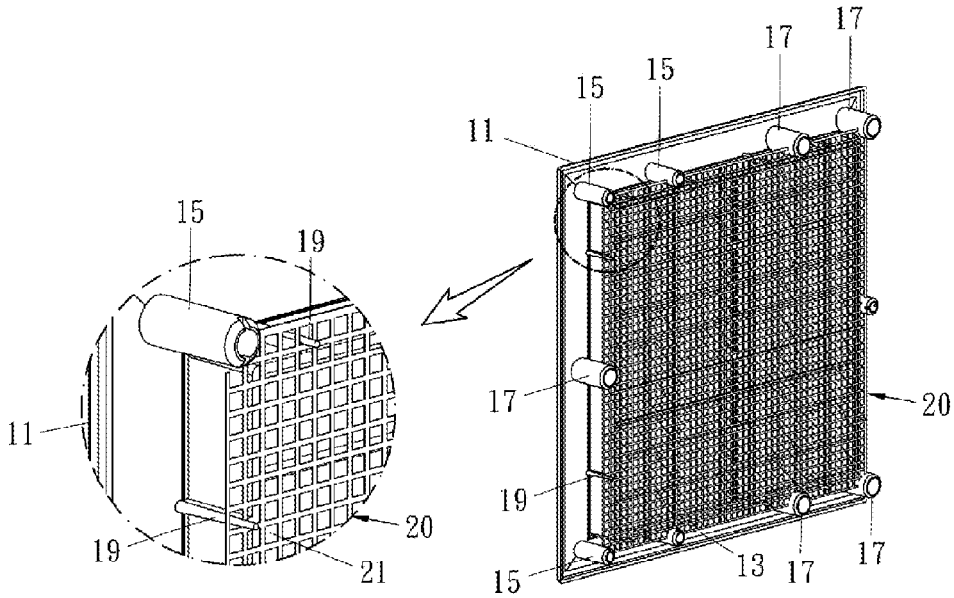
FIG. 4 is a partial assembling view of the first embodiment shown in FIG. 3; in addition, FIG. 4 further has an expanded view cut from the partial assembling view to illustrate the backside of one of the parts having protruding poles formed thereon and a screen or air filter supported on one of the parts through the corresponding meshes of the screen or air filter are properly sleeved on the protruding poles of said part.

As shown in FIGS. 3 and 4, if the screen or air filter 20 does not provide with a reinforced sealing-edge 27 arranged about its periphery, this kind of screen or air filter 20 may be still positioned and installed on each frame 11 of the grille 10, after by having the corresponding meshes 21 of the screen or air filter 20 properly sleeved on each protruding poles 19 of said frame 11. As illustrated in FIG. 5 or FIG. 6, the result is that this kind of screen or air filter 20 may be supported within the grille 10.

Figure 10:
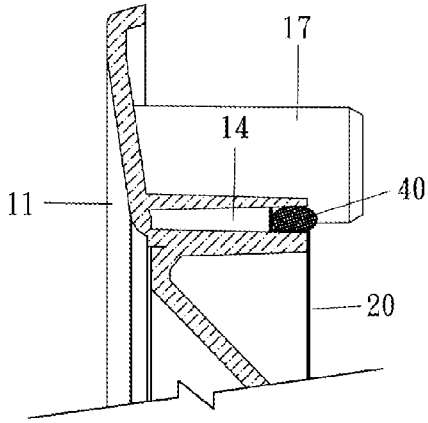
FIG. 10 is a partially expanded sectional view of the third embodiment of the present invention to illustrate a screen or air filter supported on one of the parts through the periphery of the screen or filter tightly pressed into the guide channel of one of the parts with the looped packing shown in FIG. 9.

As shown in FIGS. 9 and 10, if the frame 11 is provided with a guide channel 14 on the back side 13 and the screen or air filter 20 is not provided with a reinforced sealing-edge 27 arranged about its periphery, this kind of screen or air filter 20 may be still positioned and installed on the frame 11 of the grille 10 after the periphery of the screen or filter 20 is tightly pressed into the guide channel 14 of the frame 11 due to a looped packing 40 securely inserted into the guide channel 14 of said frame 11. As illustrated in FIG. 6, the result is that this kind of screen or air filter 20 may be supported within the grille 10.

Normally, the perimeter of said frame 11 for each part of grille 10 of the present invention is square or rectangular. However these frames can be have circular, elliptic, or semicircular shapes or other kinds of geometric shapes without departing from the spirit of the invention.

In FIGS. 3 and 6, an intermediate spacer 30 is illustrated with a first tenon element 35 at one end and a second tenon element 37 at the other end. It can be appreciated that the spacers 30 can be used between a tenon element 15 (or a mortise elements 17) on one part of said frame 11 and a mortise elements 17 (or a tenon elements 15) on the other of said frame 11, as illustrated in FIGS. 3 and 6.

Accordingly, the spacer 30 is an auxiliary component selectively used to accommodate differing thickness of a wall 80 or the like which has a greater thickness than a door 90. Further using spacers 30 of differing lengths expands the adaptability of the novel invention.

Figure 2:
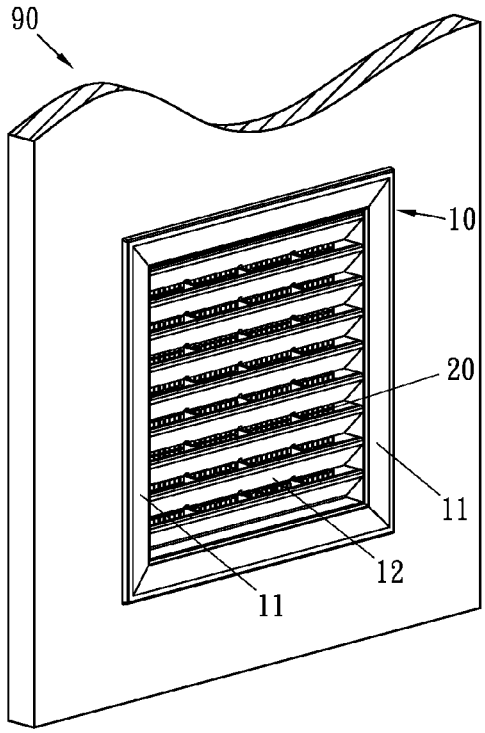
FIG. 2 is another schematic view showing the grille of the present invention fitted into an opening in a door as grating for ventilation.

In FIGS. 2 and 5, the grille 10 having one or more screens or air filters 20 supported inside if fitted into an opening in a door 90 where it can be seen the frames 11 of each part of the grille 10 forms a flange around the opening the door 90. Like the installation shown for the wall 80, the two parts of the grille 10 are locked together by the tenon elements 15 and the mortise elements 17 which are formed so that the tenon elements 15 lock into the mortise element 17 when they come together. Sometimes such cooperating tenon elements 15 and mortise elements 17 that lock when they engage are referred to as snap-on connections.

As can be seen in FIG. 5 the spacers 30 are not necessary to assemble the grille on a door 90 because the thickness of the door 90 does not require them, compared to the use of these spacers 30 for the installation in the wall 80 as showing FIG. 6.

In this invention it should be appreciated that the tenon elements 15 and the mortise elements 17 are specially designed so that the tenon elements 15 on one part of said frame 11, regardless of the degree the tenon elements 15 moves into the mortise element 17, will interlock with the mortise elements 17 on the other of said frame 11. As a result depending on the length of the tenon element 15, the novel grille 10 can easily accommodate openings of differing thicknesses because of this incremental locking feature as the two parts move toward one another with these elements engaged. Further, longer tenon elements 15 on one part of said frame 11 may be used to accommodate differing thicknesses in the openings.

What is claimed is:

1. A two part grille molded from opaque plastic and adapted to be fitted into an opening in a wall or a door comprising:

two frames, each frame being identical to the other and having lateral uprights, one frame defining a perimeter of one part of the grille and said other frame defining the other part of said grille;

a series of parallel horizontal vanes evenly spaced along the lateral uprights of each frame to form a grating;

a plurality of tenon elements and mortise elements fixed to a backside of each frame and arranged such that said tenon elements on one frame capably register with said mortise elements on the other frame when said two frames are in registration and said elements are operable to lock the two frames together when said tenon elements engage with said mortise elements mutually;

a plurality of protruding poles fixed to the backside of each frame; and one or more screens or air filters, each having a reinforced sealing-edge that is tightly in contact with the protruding poles in order to be supported by the protruding poles.

2. The grille as defined in claim 1, wherein the perimeter of each of said frames of the grille has a rectangular configuration.

3. The grille as defined in claim 1, wherein the perimeter of each of the frames of the grille have a circular configuration.

4. The grille as defined in claim 1, further comprising a plurality of spacers having a first tenon element on one end and a second tenon element on the other end, the spacers being are disposed between the tenon elements and the mortise elements of the two parts of said grille.

* * * * *